US007404750B2

(12) United States Patent
Dean et al.

(10) Patent No.: US 7,404,750 B2
(45) Date of Patent: Jul. 29, 2008

(54) METHOD FOR REDUCING LEAKAGE CURRENT IN A VACUUM FIELD EMISSION DISPLAY

(75) Inventors: Kenneth A. Dean, Phoenix, AZ (US); Bernard F. Coll, Fountain Hills, AZ (US); Emmett M. Howard, Gilbert, AZ (US); Lyndee L. Tisinger, Chandler, AZ (US)

(73) Assignee: Motorola, Inc., Schaumburg, IL (US)

( * ) Notice: Subject to any disclaimer, the term of this patent is extended or adjusted under 35 U.S.C. 154(b) by 534 days.

(21) Appl. No.: 11/263,756

(22) Filed: Oct. 31, 2005

(65) Prior Publication Data

US 2007/0097567 A1 May 3, 2007

(51) Int. Cl.
*H01J 9/44* (2006.01)

(52) U.S. Cl. ..... 445/6; 445/24

(58) Field of Classification Search ..... 445/6, 445/24, 49–51

See application file for complete search history.

(56) References Cited

U.S. PATENT DOCUMENTS 6,645,028 B1 11/2003 Dean et al.
7,204,739 B2 * 4/2007 Kamide et al. ..... 445/49

OTHER PUBLICATIONS

Philip G. Collins, et al., Engineering Carbon Nanotubes and Nanotube Circuits Using Electrical Breakdown, Science Magazine, Apr. 27, 2001, vol. 292 pp. 706-709, USA, www.sciencemag.org.

* cited by examiner

*Primary Examiner*—Joseph L Williams

(57) ABSTRACT

A fabrication process is provided for reducing leakage current in a field emission display having at least one electron emitter (24) electrically coupled to a ballast resistor (16) coupled to a cathode metal (14), wherein at least one defect (28) extends to a gate electrode (20) from a region (22) electrically coupled to the ballast resistor, the method comprising heating (32) to reduce the resistance of the ballast resistor; and applying (34) a voltage between the cathode metal and the gate electrode thereby creating a current through the at least one defect to create an electrical open therein.

22 Claims, 1 Drawing Sheet

METHOD FOR REDUCING LEAKAGE CURRENT IN A VACUUM FIELD EMISSION DISPLAY

FIELD OF THE INVENTION

The present invention generally relates to field emission displays and more particularly to a fabrication process for reducing leakage current in a vacuum field emission display.

BACKGROUND OF THE INVENTION

Carbon is one of the most important known elements and can be combined with oxygen, hydrogen, nitrogen and the like. Carbon has four known unique crystalline structures including diamond, graphite, fullerene and carbon nanotubes. In particular, carbon nanotubes refer to a helical tubular structure grown with a single wall or multi-wall, and commonly referred to as single-walled nanotubes (SWNTs), or multi-walled nanotubes (MWNTs), respectively. These types of structures are obtained by rolling a sheet formed of a plurality of hexagons. The sheet is formed by combining each carbon atom thereof with three neighboring carbon atoms to form a helical tube. Carbon nanotubes typically have a diameter in the order of a fraction of a nanometer to a few hundred nanometers.

A carbon nanotube is known to be useful for providing electron emission in a vacuum device, such as a field emission display, because of a higher current density than tip emitters. Additionally, the use of a carbon nanotube as an electron emitter has reduced the cost of vacuum devices, including the cost of a field emission display. The reduction in cost of the field emission display has been obtained with the carbon nanotube replacing other electron emitters (e.g., a Spindt tip), which generally have higher fabrication costs as compared to a carbon nanotube based electron emitter.

However, vacuum field emission devices are commonly plagued with emission currents that have leakage current flowing through a defect, e.g., particles, or nanotube grown unintentionally from a cathode to a gate electrode. In many electronic devices, these defects can be 'blown-out' by applying excessive voltage and current to the electrodes. This technique has been demonstrated in nanotube transistor research (not a vacuum field emission device) where excessive current has been used to destroy conductive nanotubes and nanotube walls in preference to semiconducting nanotubes. However, in the case of field emission devices which typically incorporate a ballast resistor in series with the emitter to limit destructive current to the nanotube, this technique is ineffective due to the current limiting ballast resistor.

A known method of improving uniformity of emission current reduces the length of longer emitters by causing a burn-in current to be emitted by the emitters with the longer emitters being reduced more than the shorter emitters due to the field created at the emitter tip. This known method reduces the effect of a ballast resistor by heating to a high temperature; however, this method does not reduce leakage or defects, and it cannot be performed in ambient air or at high pressure.

Accordingly, it is desirable to provide a fabrication process for reducing leakage current in a vacuum field emission display. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A fabrication process is provided for reducing leakage current in a field emission display having at least one electron emitter electrically coupled to a ballast resistor coupled to a cathode metal, wherein at least one defect extends to a gate electrode from a region electrically coupled to the ballast resistor, the method comprising heating to reduce the resistance of the ballast resistor; and applying a voltage between the cathode metal and the gate electrode thereby creating a current through the at least one defect to create an electrical open therein.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Field emission displays apply a bias between a gate electrode and an emitter on a cathode to produce a field emission current. If a defect such as a particle or an extra-long nanotube bridges the gate electrode and the cathode, then a leakage current results which is often detrimental to the proper operation of the display. In typical vacuum field emission displays, a ballast resistor is positioned between the cathode and the electron emitters to create a more uniform current between groups of subpixels and provide good lifetime by preventing destructive current levels through the emitters. However, the ballast resistor prevents removal of the defect or extra-long nanotube by limiting the current to non-destrucive levels.

Figure 1:
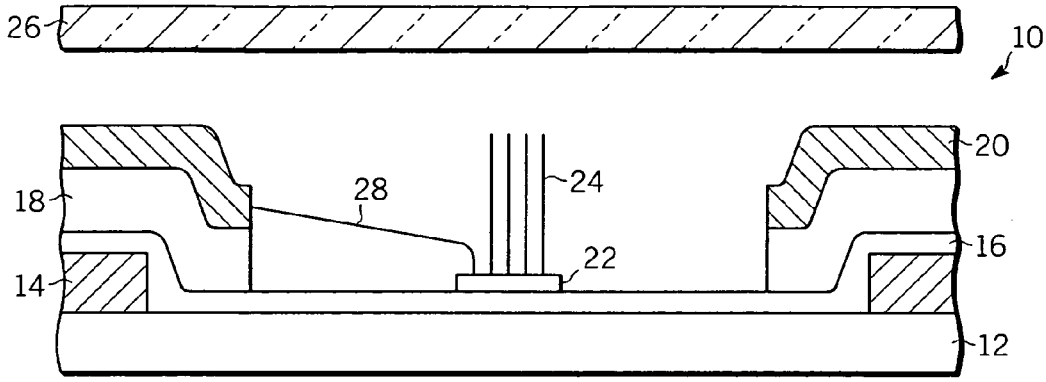
FIG. 1 is a partial cross section of a field emission structure illustrating unintentional nanotube growth.

Referring to FIG. 1, a previously known process for forming a cathode 10, which may be used with the present invention, include depositing a cathode metal 14 on a substrate 12. The substrate 12 comprises silicon; however, alternate materials, for example, silicon, glass, ceramic, metal, a semiconductor material, or a organic material are anticipated by this disclosure. Substrate 12 can include control electronics or other circuitry, which are not shown in this embodiment for simplicity. The cathode metal 14 is molybdenum, but may comprise any metal. A ballast resistor layer 16 of a semiconductor material is deposited over the cathode metal 14 and the substrate 12. A dielectric layer 18 is deposited over the ballast resistor above the cathode metal 14 to provide spacing for the gate electrode 20. The gate electrode 20 comprises a conductor, for example, chrome-copper-chrome layers. The above layers and materials are formed by standard thin or thick film techniques known in the industry.

The catalyst 22 preferably comprises nickel, but could comprise any one of a number of other materials including cobalt, iron, and a transition metal or oxides and alloys thereof. Additionally, the catalyst 22 may be formed by any process known in the industry, e.g., evaporation, sputtering, precipitation, wet chemical impregnation, incipient wetness impregnation, adsorption, ion exchange in aqueous medium or solid state, before having the present invention applied thereto. One preferred method would be to form a relatively smooth film and subsequently etching the film to provide a rougher surface.

Carbon nanotubes 24 are then grown from the catalyst 22 in a manner known to those skilled in the art. Although only a few carbon nanotubes 24 are shown, those skilled in the art understand that any number of carbon nanotubes 24 could be formed. It should be understood that any nanotube or electron emitter having a height to radius ratio of greater than 100, for example, would function equally well with some embodiments of the present invention.

Anode plate 26 includes a solid, transparent material, for example, glass. Typically, a black matrix material (not shown) is disposed on the anode plate to define openings (not shown) representing pixels and sub-pixels containing a phosphor material (not shown) in a manner known to those in the industry. The phosphor material is cathodoluminescent and emits light upon activation by electrons, which are emitted by carbon nanotubes 24.

As used herein, carbon nanotubes include any elongated carbon structure. Preferably, the carbon nanotubes 24 are grown on a line from the cathode 10 (more particularly the catalyst 22 in this exemplary embodiment) towards the anode 26. However, many times, one or more carbon nanotubes 28 undesirably grow from the catalyst 22 toward, and attach to, the gate electrode 20. This undesirable growth of carbon nanotubes 28 cause a leakage current during normal operation from the cathode metal 14, through the ballast resistor layer 16 and the carbon nanotube 28 to the gate electrode 20.

Preferential heating of defects generally increases their chemical reactivity, and consequently, performing the 'burn-out' in a reactive atmosphere enhances the effectiveness of the burn-out process. Since defects such as carbon nanotubes and organic traces react with either reducing agents such as hydrogen and ammonia or oxyidizing agents such as oxygen or air, performing the burn-out in either of these environments will facilitate local destructive of the defect.

Figure 2:
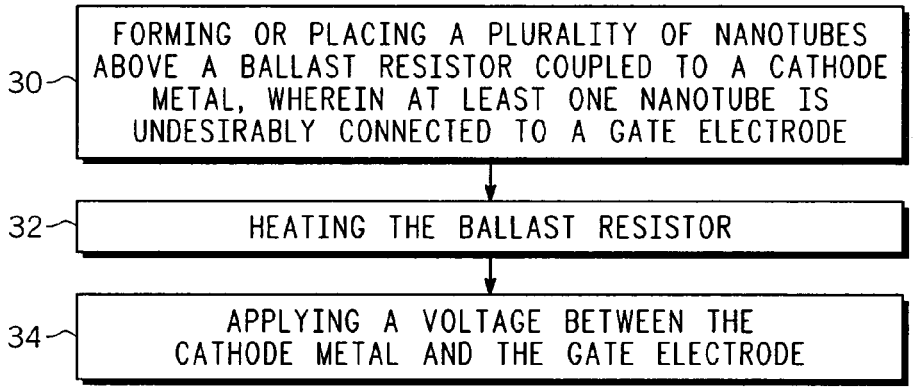
FIG. 2 is a flow chart of a fabrication process in accordance with an exemplary embodiment.

Referring to FIG. 2, a method in accordance with an exemplary embodiment comprises, after the structure of FIG. 1 is fabricated 30, heating 32 the cathode 10 and more specifically the ballast resistor 16 to substantially reduce its electrical resistance. The ballast resistor 16 typically would comprise a resistance of about 100 meg ohms; however, after heating to about 200° C. to 300° C., the resistance will be of about one to a few meg ohms. While this temperature of about 200° C. to 300° C. affects the ballast resistor 16, it is too low to affect the other components. The ballast resistor is typically engineered to have a low change in value over temperature to 85° C. (Mil Spec). The other components include the metal bus lines nanotubes, the nanotubes, and other materials used in the manufacture of the device. The reactive environment used to 'burn-out' the defects is deleterious to these components in different ways. For example, the reaction of oxygen with the metal lines causes metal oxide formation which inhibits good electrical contact, compromises mechanical stability, and incorporates lifetime-reducing chemistry into the device. This reaction threshold defines a narrow window wherein the burn-out technique is effective. For Molybdenum metal lines and typical ballast materials (a-Si, $Ta_xSi_yN$, etc.), a 200° C. to 300° C. temperature range provides a window for defect 'burn-out'. However, copper metallization oxidizes heavily below 150° C., so there is no window for 'burn-out'. Cr—Cu—Cr stacks provide a better window while realizing the high conductivity of copper. The nanotubes are also sensitive to reactions. Temperatures above 450° C. in air often cause degradation of the nanotube emitters. In various burn-out environments, the temperature range could nominally lie between 100° C. to 500° C. In addition, the 'burn-out' step includes applying a bias to the defects, which will apply a field to the nanotubes. If the bias is applied in the polarity for field emission, then the nanotubes will attempt to emit electrons in a high pressure, reactive (oxidizing or reducing) atmosphere, at relatively high temperature. Degradation of the nanotube's field emission property results above a certain threshold combination of temperature and applied field. If the bias is applied in the polarity opposite field emission, the degradation threshold is typically higher in temperature and field, although field emission degradation does occur.

Figure 3:
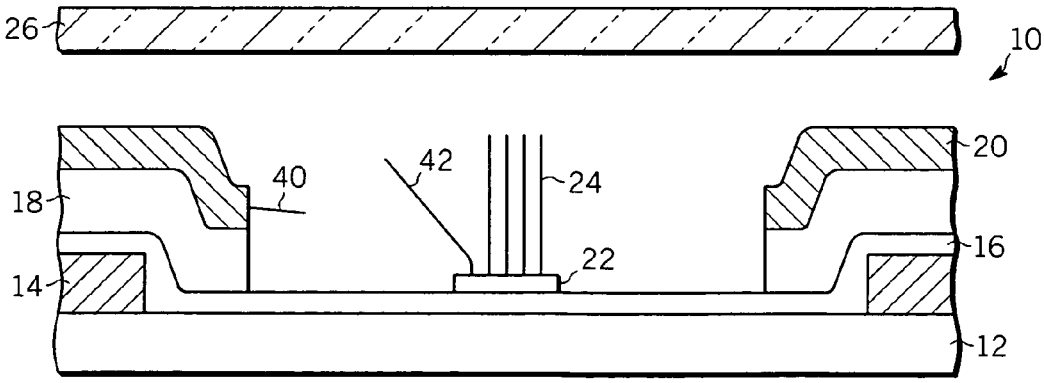
FIG. 3 is a partial cross section of the field emission structure of FIG. 1 after being subjected to the fabrication process of FIG. 2.

Referring again to FIG. 2, a voltage is applied 34, preferably one gate at a time, between the cathode 14 and the gate electrode 20 to create a relatively high current to eliminate by burn out the "short" caused by the defect, e.g., carbon nanotube 28. The voltage may be applied continuously (D.C), or it may be applied at high frequency to enhance preferential heating at the defect. This voltage may be biased in either direction, preferable a voltage of 50 volts is applied to the cathode 14 with the gate electrode 20 being grounded. Alternatively, about 40 volts could be applied to the gate electrode 20 with the cathode 14 grounded. The bias may also be applied with switching bias similar to alternating current electrical heaters. The bias may also be applied with a constant current source. Regardless of the bias direction, current will flow through the ballast resistor 16 and the carbon nanotube 28 or other defect. The current will be of high enough magnitude to burn the carbon nanotube 28 or other defect, causing an "open", leaving a first section 40 (FIG. 3) affixed to the gate electrode 20 and a second section 42 attached to the catalyst 22. The burning is in part caused by high temperature in the defect caused by the high current. Therefore, the electron path (current leakage) through carbon nanotube 28 to the gate electrode 20 has been eliminated. The carbon nanotube 42 may now function normally as the other carbon nanotubes 24.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims.

What is claimed is:

1. A method for reducing leakage current of a vacuum field emission device having at least one electron emitter electrically coupled to a ballast resistor coupled to a cathode metal, wherein at least one defect extends to a gate electrode from a region electrically coupled to the ballast resistor, the method comprising:

heating to reduce the resistance of the ballast resistor; and applying a voltage between the cathode metal and the gate electrode, thereby creating a current through the at least one defect to create an electrical open therein.

2. The method of claim 1 wherein the at least one defect comprises at least one carbon nanotube electronically coupled between the cathode metal and the gate electrode and the applying step comprises creating an electrical open within the at least one carbon nanotube.

3. The method of claim 1 wherein the heating step comprises heating in the range of 100° C. to 500° C.

4. The method of claim 1 wherein the heating step comprises heating in the range of 200° C. to 350° C. in an oxidizing atmosphere.

5. The method of claim 1 wherein the heating step comprises reducing the resistance of the resistor from about 100 meg ohms to about 1 meg ohms.

6. The method of claim 1 wherein applying a voltage comprises applying a voltage of 40 volts to the at least one defect with forward bias to the at least one emitter.

7. The method of claim 1 wherein applying a voltage comprises applying a voltage of 50 volts to the at least one defect with reverse bias to the at least one emitter.

8. The method of claim 1 wherein the heating step comprises heating in one of a reactive environments comprising hydrogen, oxygen, ambient air, or ammonia.

9. The method of claim 1 wherein the heating step comprises heating at a pressure greater than one torr.

10. The method of claim 1 wherein applying a voltage step comprises applying one of a pulsed voltage, a high frequency voltage, or an alternating current voltage.

11. The method of claim 1 wherein applying a voltage step comprises supplying a constant current.

12. A method for reducing leakage current of a field emission device having a plurality of carbon nanotubes grown above a ballast resistor coupled to a cathode metal for emitting electrons at an anode, wherein a carbon nanotube extends to a gate electrode, the method comprising:

heating to reduce the resistance of the ballast resistor; and applying a voltage between the cathode metal and the gate electrode to create an electrical open within the carbon nanotube.

13. The method of claim 12 wherein the heating step comprises heating in the range of 200 to 300° C.

14. The method of claim 12 wherein the heating step comprises reducing the resistance of the ballast resistor from about 100 meg ohms to about 1 meg ohms.

15. The method of claim 12 wherein applying a voltage comprises applying a voltage of 40 volts to the defect with forward bias to the plurality of carbon nanotubes.

16. The method of claim 12 wherein applying a voltage comprises applying a voltage of 50 volts to the defect with reverse bias to the plurality of carbon nanotubes.

17. The method of claim 12 wherein the heating step comprises heating in one of a reactive environments comprising hydrogen, oxygen, ambient air, or ammonia.

18. The method of claim 12 wherein the heating step comprises heating at a pressure greater than one torr.

19. The method of claim 12 wherein applying a voltage step comprises applying one of a pulsed voltage, a high frequency voltage, or an alternating current voltage.

20. A method for reducing leakage current in a vacuum field emission device having a ballast resistor positioned between a cathode metal and a plurality of carbon nanotube emitters positioned on the anode, wherein at least one defect is undesirably coupled between the cathode metal and a gate electrode, the method comprising:

heating the ballast resistor; and applying a voltage between the cathode metal, through the ballast resistor and the at least one carbon nanotube emitters, to the gate electrode.

21. The method of claim 20 wherein the heating step comprises heating in the range of 200 to 350° C.

22. The method of claim 20 wherein the heating step comprises heating in one of a reactive environments comprising hydrogen, oxygen, ambient air, or ammonia.

* * * * *